US006179232B1

(12) United States Patent
Schumacher

(10) Patent No.: US 6,179,232 B1
(45) Date of Patent: Jan. 30, 2001

(54) APPARATUS AND METHOD FOR CHIPPING WOOD DEBRIS

(75) Inventor: Neil J. Schumacher, Mt. Pleasant, MI (US)

(73) Assignee: Morbark, Inc., Winn, MI (US)

( * ) Notice: Under 35 U.S.C. 154(b), the term of this patent shall be extended for 0 days.

(21) Appl. No.: 09/383,687

(22) Filed: Aug. 26, 1999

(51) Int. Cl.[7] ..... B02C 19/12

(52) U.S. Cl. ..... 241/28; 241/56; 241/60; 241/280

(58) Field of Search ..... 144/172, 176; 241/60, 92, 28, 56, 280, 281, 282

(56) References Cited

U.S. PATENT DOCUMENTS

| | | |
|---|---|---|
| 3,123,311 | 3/1964 | Fontaine . |
| 3,276,700 | 10/1966 | Eklund . |
| 3,332,461 | 7/1967 | Ledergerber . |
| 3,410,495 | 11/1968 | Eklund . |
| 3,635,410 | 1/1972 | Smith . |
| 3,682,400 | 8/1972 | Smith . |
| 5,060,873 | 10/1991 | Strong . |
| 5,240,188 | 8/1993 | Whitmire . |
| 5,240,189 | 8/1993 | Majkrzak et al. . |

*Primary Examiner*—Mark Rosenbaum
(74) *Attorney, Agent, or Firm*—Reising, Ethington, Barnes, Kisselle, Learman & McCulloch, P.C.

(57) ABSTRACT

A wood chipping apparatus includes a housing having a chipping chamber and an air chamber isolated by a fixed partition wall of the housing. A chipping drum is supported for rotation in the chipping chamber. A fan is supported for rotation in the fan chamber. The chambers have adjacent outlets that communicate with a discharge chute. Wood chips exiting the chipping chamber are received in the chute and are entrained by air issuing from the fan chamber to carry the chips along the chute. A baffle separates the outlets of the chambers and ensures that the air from the fan chamber does not backflow into the chipping chamber through its material outlet.

8 Claims, 3 Drawing Sheets

3

52
82
50
36
22
72
18
10
42
84
20
86
42
54
86
78
66
34
76
38
28
72
66
26
72
86
72
58
60
42
42
86
68
70
74
64
62
3

APPARATUS AND METHOD FOR CHIPPING WOOD DEBRIS

This invention relates generally to drum-type wood chippers and more particularly to the handling of the wood chips during discharge.

BACKGROUND OF THE INVENTION

Drum-type wood chippers of the kind typically used to chip tree limbs and other wood debris include a housing having an internal chamber in which a chipper drum is supported for driven rotation. The drum carries a plurality of cutting knives spaced about its perimeter which, when wood debris is fed into the chamber, reduce the limbs and such to chips. The chips are discharged through an outlet in the chamber and transported by their momentum along a discharge chute for collection, typically in a chamber or bin, such as that provided on a towing vehicle used to transport the chipper.

As the type of wood and size of the chips can vary, it is not uncommon for some of the chips to be too light such that they have insufficient momentum to travel the length of the discharge chute and collect in the chamber. One proposed solution to the problem has been to add fan blades to the side of the drum in order to generate a flow of air in the chipping chamber to help carry the chips along. The flow of air, however, is difficult to control and in some cases an undesirable backflow develops wherein dust and light debris is discharged through the material inlet.

Another proposal has been to equip such chippers with a fan external to the housing that is driven off the drum shaft and is coupled by a hose to the discharge chute for creating an air flow in the chute downstream of the outlet which acts to draw and carry the chips along and into the collection bin. While such external fan devices are effective at entraining the chips, there is not always room enough on the chipper apparatus to accommodate the mounting of the external fan assembly. Further, the necessity for an additional air hose from the fan to the discharge chamber detracts from the appearance of the chipper apparatus, is prone to damage, and adds to the maintenance and cost of the apparatus.

SUMMARY OF THE INVENTION

Apparatus for reducing wood debris to chips comprises a support frame having a housing mounted thereon with an internal chipping chamber having a circumferentially extending chamber wall. A chipping drum is supported for driven rotation within the chamber and communicates with a material inlet provided in the chamber wall for introducing wood debris into the chipper chamber for reduction to chips by the drum. A material outlet is provided in the wall for discharging the wood chips from the chamber. A discharge chute is coupled at a receiving end thereof to the housing in communication with the material outlet for receiving and guiding the chips outwardly of the housing to an opposite discharge end of the chute.

According to a characterizing feature of the invention, the apparatus includes a chip entrainment system comprising an internal fan chamber provided in the housing adjacent the chipping chamber that is isolated from the chipping chamber by a fixed partition wall of the housing. A fan is supported for driven rotation within the fan chamber and is operative to draw air into the air chamber through an air inlet of the fan chamber and to discharge a high velocity flow of air through an outlet of the fan chamber in communication with the receiving end of the discharge chute. A baffle is provided in the chute between the chipping and fan outlets of the housing. Air entering the chute from the fan chamber joins the flow of chips issuing from the drum chamber at a location downstream of the material outlet of the chipping chamber so as to entrain the chips and carry them forward toward the discharge end of the chute. The baffle prevents the stream of air from backflowing into the chipping chamber through the material outlet thereof.

The invention offers several advantages over the known prior art chip handling systems, including integrated the air flow system into the housing, eliminating space problems associated with externally mounted fans and the necessity for an external air hose to communicate with the chute. The fixed partition wall and baffle ensure that the air flow generated by the fan entrains the chips as desired downstream of the material outlet, while preventing the air flow from entering the chipping chamber and causing debris to be ejected through the material inlet.

THE DRAWINGS

A presently preferred embodiment of the invention is disclosed in the following description and in the accompanying drawings, wherein.

DETAILED DESCRIPTION

Figure 1:
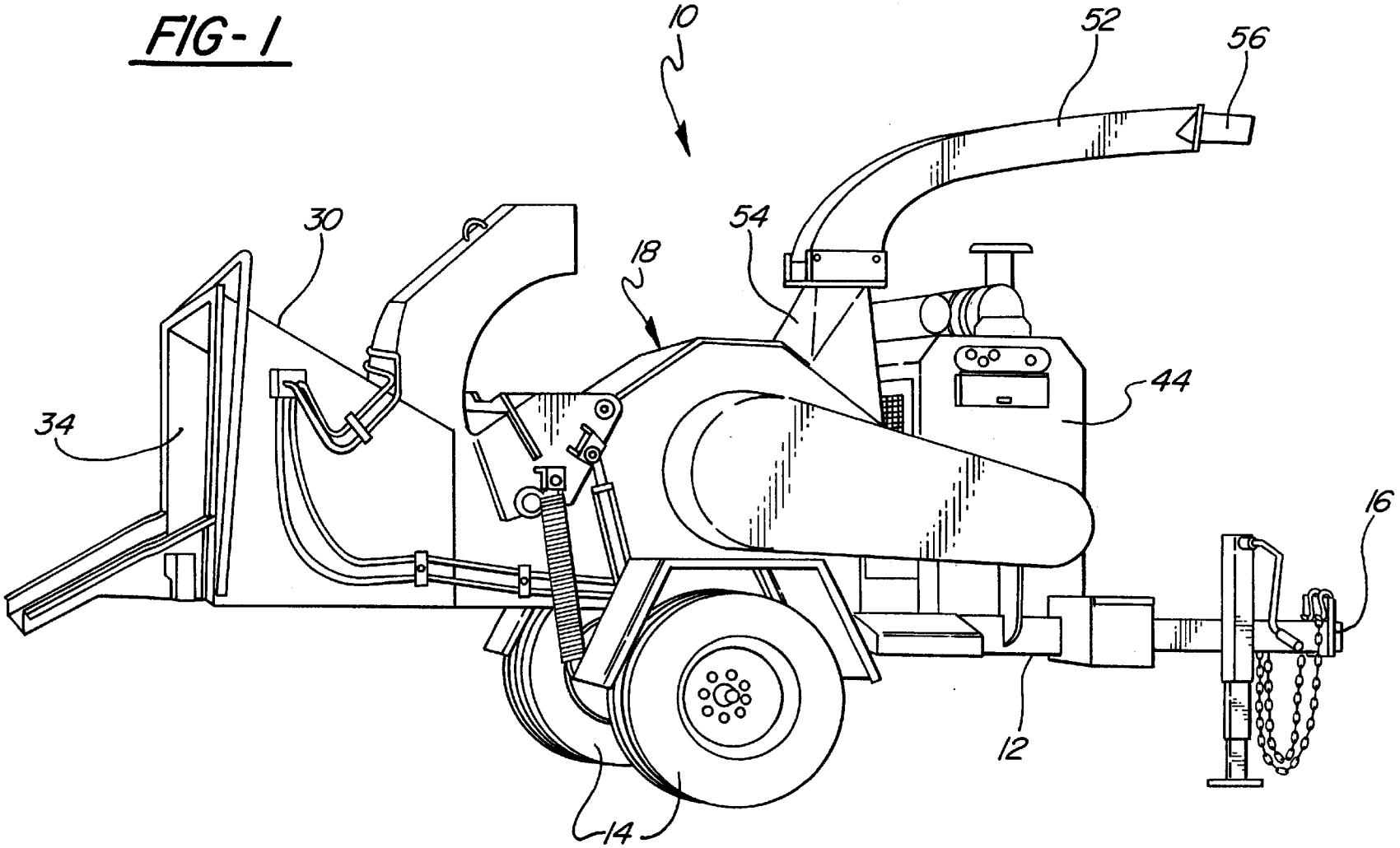
FIG. 1 is a side elevational perspective view of a chipping apparatus constructed according to a presently preferred embodiment of the invention.

Apparatus for reducing tree limbs, branches, and similar wood debris to chips is shown generally at 10 in FIG. 1 and comprises a support frame 12 mounting a set of wheels 14 and having a coupling 16 at its forward end for coupling the apparatus 10 to a towing vehicle (not shown). While any of a number of towing vehicles would be suitable, the preferred towing vehicle is the type having a collection bin that is open at the back to receive the wood chips discharged from the apparatus 10, as will be explained further below.

Figure 3:
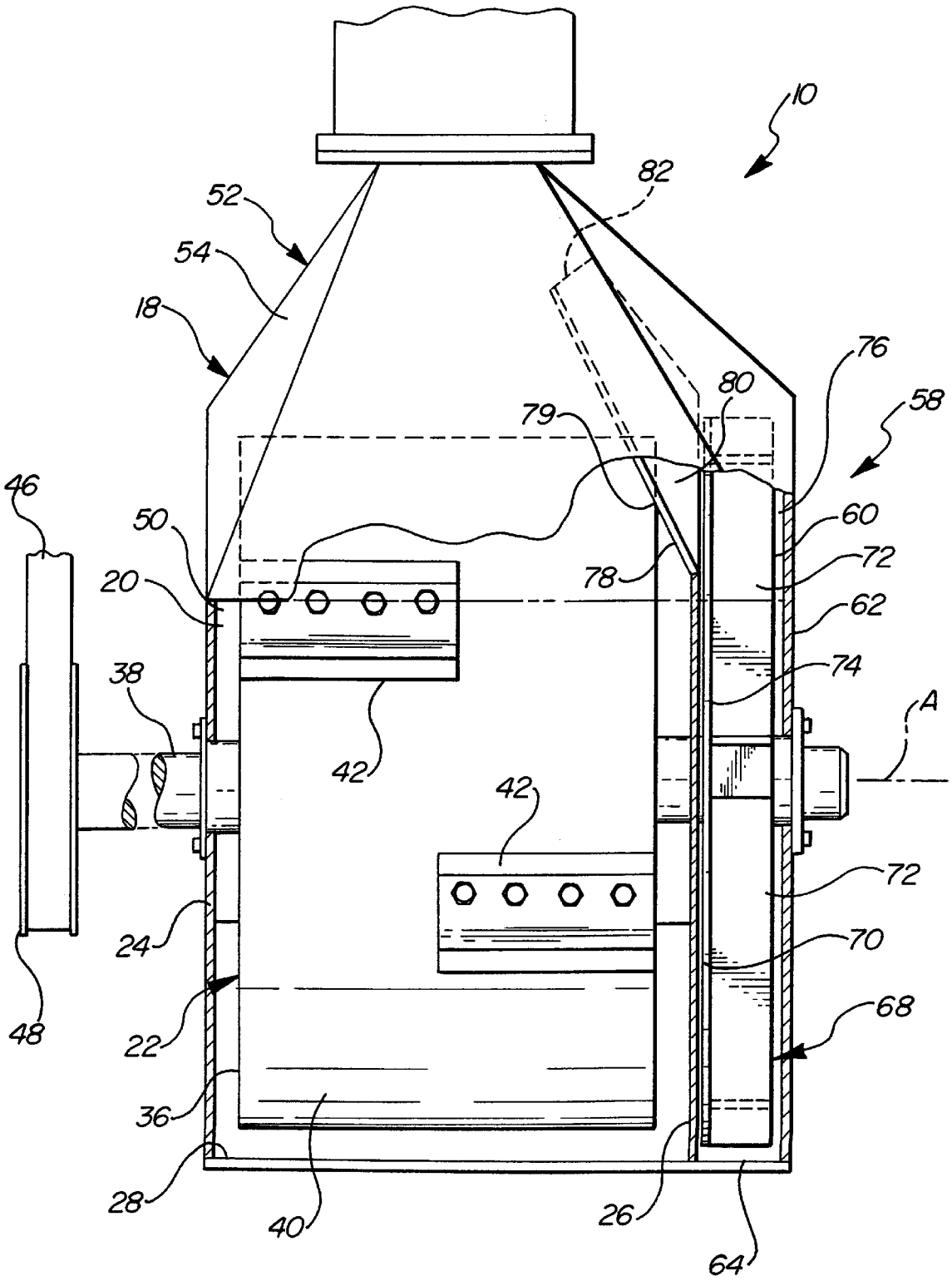
FIG. 3 is a fragmentary end view, shown partly broken away taken generally along lines 3—3 of FIG. 2.

A housing 18 is mounted on the frame 12 and includes an internal chipping chamber 20 in which a chipping drum 22 is supported for driven rotation about an axis A, as shown best in FIG. 3. The chipping chamber 20 includes axially spaced end walls 24, 26 and a peripheral circumferentially extending wall 28 joined such as by welding to provide the internal chamber 20.

As shown best in FIG. 1, a material feed chute 30 extends longitudinally rearwardly from the housing 18 to an open end 32 into which wood debris to be chipped is fed by an attendant. Within the chute 30 is a rotatably driven feed drum (not shown) which engages and feeds the wood debris at a predetermined rate into the chipping chamber 20 through a material inlet 34 provided in the peripheral chamber wall 28. As the wood debris enters the chipping chamber 20, it encounters the chipping drum 22. The drum 22 is preferably of the usual type having a cylindrical drum body 36 fixed to a drive shaft 38 and having a circumferentially extending wall 40 generally parallel to and spaced radially from the wall 28 of the housing 18. A plurality of replaceable chipping knives 42 are mounted about the wall 40 for rotation therewith about the axis A. The shaft 38 extends through and is journaled by the end walls of the housing 18 and is coupled to a drive motor 44 mounted on the frame 12 by a suitable drive connection, such as belt and pulleys 46, 48.

Figure 2:
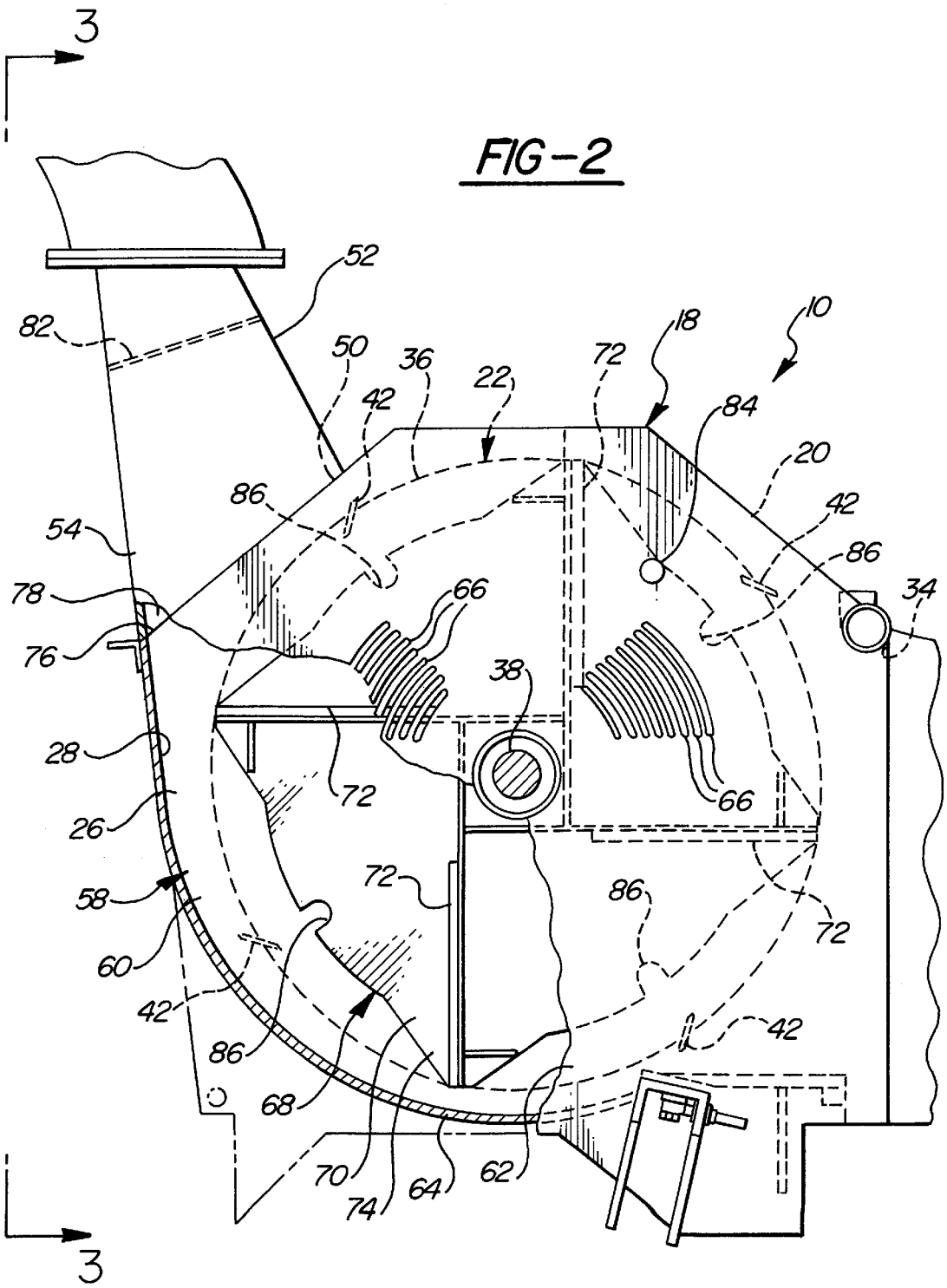
FIG. 2 is an enlarged fragmentary elevation view of the apparatus shown partly broken away.

The drum 22 is rotated at high velocity in a downwardly, clockwise direction as viewed in FIG. 2, such that the debris fed into the chamber 20 passes beneath the drum 22. As the wood debris encounters the drum, the knives 42 reduce the material to wood chips. The high velocity of the drum carries the chips through the chamber 20 and ejects them through a material outlet 50 provided in the chamber wall 28 on the opposite side of the housing 18 as that of the material inlet 34.

The apparatus 10 includes a discharge chute 52 coupled at a receiving end 54 thereof to the housing 18 in communication with the material outlet 50 for receiving and guiding the wood chips expelled from the chipping chamber 20 outwardly of the housing 18 to an opposite discharge end 56 of the chute 52, where they are expelled into an adjacent collection bin, such as that on the towing vehicle.

The chipping apparatus 10 thus far described is conventional in construction and operation to existing wood chipping apparatus, such as the E-Z BEEVER® wood chippers manufactured by Morbark, Inc., of Winn, Mich.

In order to enhance the flow of the wood chips along the discharge chute 52 to assure that the lighter wood chip material has sufficient momentum to traverse the length of the chute and discharge into the adjacent collection bin of the tow vehicle, the apparatus 10 is provided with a chip entrainment system indicated generally at 58 in FIGS. 2 and 3. The system 58 includes an internal fan chamber 60 provided in the housing 18 axially adjacent the chipping chamber 20. The fan chamber 60 is preferably formed as an extension of the chipping chamber 20 and includes an outer end wall 62 and an extension 64 of the circumferential wall 28 of the chipping chamber 20. The end wall 26 of the chipping chamber 20 is internal to the housing 18 and serves as a fixed, solid partition separating the chipper chamber 20 from the fan chamber 60 and thereby preventing air from the fan chamber 60 from entering the chipping chamber 20 through the partition wall 26.

As shown best in FIG. 2, the fan chamber 60 includes a plurality of air inlets 66 formed in the outer end wall 62 of the fan chamber 60 communicating with the external atmosphere to draw air into the chamber 60. A fan 68 is supported in the chamber 60 for driven rotation, and preferably is fixed to a section of the drive shaft 38 extending through the chamber 60 for conjoint rotation with the drum 22. The fan 68 includes a disc-like body 70 fixed to the shaft 38 adjacent the partition wall 26 mounting a plurality of fan blades 72 fixed to a side 74 of the body 70 facing away from the chipper chamber 20 for rotation therewith. The fan chamber 60 has an air outlet 76 adjacent the material outlet 50 of the chipper chamber 20. The receiving end 54 of the discharge chute 52 communicates with the air outlet 76. A baffle 78 extends form the housing 18 into the discharge chute 52 between the material outlet 50 and air outlet 76, dividing the receiving end 54 of the discharge chute 52 into a chip side 79 communicating with the chipping chamber 20 and an air side 80 communicating with the fan chamber 60. The baffle 78 is preferably formed as an extension of the partition wall 26 and terminates within the receiving end 54 of the chute 52 at a free end 82 that is downstream of the material and air outlets 50, 76.

In operation, the fan 68 rotates with the drum and draws air into the chamber 60 through the air inlets and discharges a high velocity flow of air into the discharge chute through the air outlet 76 where it is directed by the walls of the discharge chute and the baffle 78 downstream of the chute where it joins with and entrains the flow of wood chips downstream of the free end 82 and carries the chips toward the discharge end 56 of the chute 52 with sufficient velocity and momentum to ensure that the chips are discharged into the adjacent collection bin. The partition wall 26 and baffle 78 ensure that the entrainment air does not enter the chipping chamber 20 and cause undesirable turbulence that would interfere with the flow of the chips through the material outlet 50, and particularly prevents any such air from entering the chipping chamber and causing dust and light wood debris to be discharged through the material inlet 34 of the apparatus 10.

For purposes of maintenance, it is desirable to be able to selectively secure the drum 22 and fan 60 against rotation relative to the housing 18. For this purpose, the end wall 62 of the fan chamber 60 is formed with at least one opening 84 that aligns with at least one corresponding opening 86 in the body of the fan 70 for receiving a stop bar or suitable tool therein (not shown) from outside the housing 18, preventing the fan 68 and thus the drum 22 from rotating about its axis A.

The disclosed embodiment is representative of a presently preferred form of the invention, but is intended to be illustrative rather than definitive thereof. The invention is defined in the claims.

What is claimed is:

1. Apparatus for reducing wood debris to chips comprising:

a support frame having a housing mounted thereon with an internal chipping chamber having a circumferentially extending chamber wall;

a chipping drum supported for driven rotation within said chipping chamber;

a material inlet provided in said chamber wall for introducing wood debris into said chipping chamber for reduction to chips by said drum;

a material outlet provided in said chamber wall for discharging the wood chips from said chipping chamber;

a discharge chute coupled at a receiving end to said housing in communication with said material outlet for receiving and guiding the chips outwardly of said housing to an opposite discharge end of said chute; and a chip entrainment system including an internal fan chamber provided in said housing adjacent said chipping chamber, a fixed partition wall of said housing isolating said chipping chamber from said fan chamber, an air inlet provided in said fan chamber, a fan supported for driven rotation within said fan chamber for generating a flow of air, an air outlet provided in said fan chamber in flow communication with said receiving end of said discharge chute for directing the flow of air into said discharge chute, and a baffle extending from said housing into said discharge chute to a free end thereof spaced from said material outlet of said chipping chamber separating said receiving end of said chute into a chip side communicating with said material outlet of said chipping chamber and an air side communicating with said air outlet of said fan chamber such that the air flow issuing from said fan chamber joins the flow of chips issuing from said drum chamber at a location downstream of said material outlet for entraining the chips and carrying them toward said discharge end of said chute and while preventing such air from backflowing into said chipping chamber through said material outlet.

2. The apparatus of claim 1 including a drive shaft mounting said drum and said fan.

3. The apparatus of claim 2 wherein said shaft passes through and is rotatable relative to said partition wall.

4. The apparatus of claim 1 wherein said air inlet of said fan chamber is spaced from said drum chamber.

5. The apparatus of claim 4 wherein said air inlet comprises an opening in said housing communicating with atmosphere external to said chamber.

6. The apparatus of claim 1 wherein said drum includes peripherally mounted cutting knives.

7. The apparatus of claim 1 wherein said fan chamber includes an end wall opposite said partition wall formed with at least one opening therein and said fan includes at least one opening alignable with said opening of said end wall for receiving a lock bar therethrough to preclude rotation of said fan.

8. A method of reducing wood debris to chips in a chipping apparatus including a housing having an internal chipping chamber with a circumferentially extending chamber wall, a chipping drum supported for driven rotation within the chipping chamber, a material inlet provided in the chamber wall for introducing wood debris into the chipping chamber for reduction to chips therein by the drum, a material outlet provided in the chamber wall for discharging the wood chips from the chipping chamber, and a discharge chute coupled at a receiving end thereof to the housing in communication with the material outlet for receiving and guiding the chips outwardly of the housing to an opposite discharge end of the chute; said method including:

providing the chipping apparatus with an air flow chip entrainment system including an internal fan chamber provided in the housing adjacent the chipping chamber, a fixed partition wall of the housing isolating the chipping chamber from the fan chamber, an air inlet provided in the fan chamber, a fan supported for driven rotation within the fan chamber for generating a flow of air, an air outlet provided in the fan chamber in flow communication with the receiving end of the discharge chute for directing the flow of air into the discharge chute, and a baffle extending from the housing into the discharge chute to a free end thereof spaced from the material outlet of the chipping chamber separating the receiving end of the chute into a chip side communicating with the material outlet of the chipping chamber and an air side communicating with the air outlet of the fan chamber; and feeding wood debris into said chipping chamber where it is reduced to chips by the drum and directed into the discharge chute on the chip side of the baffle, while operating the fan to direct a flow of air into the discharge chamber on the air side of the baffle such that the air flow issuing from the fan chamber joins the flow of chips issuing from the drum chamber at a location downstream of the material outlet and entrains the chips and carries them toward the discharge end of the chute while preventing the air from backflowing into the chipping chamber through the material outlet.

* * * * *